US007824019B2

(12) United States Patent
Gao et al.

(10) Patent No.: US 7,824,019 B2
(45) Date of Patent: Nov. 2, 2010

(54) CONTINUOUS PRINTING APPARATUS HAVING IMPROVED DEFLECTOR MECHANISM

(75) Inventors: Zhanjun Gao, Rochester, NY (US); Jinquan Xu, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 810 days.

(21) Appl. No.: 11/744,987

(22) Filed: May 7, 2007

(65) Prior Publication Data

US 2008/0278547 A1 Nov. 13, 2008

(51) Int. Cl.
*B41J 2/09* (2006.01)

(52) U.S. Cl. ..... 347/77

(58) Field of Classification Search ..... 347/73, 347/74, 77

See application file for complete search history.

(56) References Cited

U.S. PATENT DOCUMENTS 4,068,241 A 1/1978 Yamada
4,097,872 A 6/1978 Giordano et al.
4,297,712 A 10/1981 Lammers et al.
6,081,281 A * 6/2000 Cleary et al. ..... 347/21
6,457,807 B1 10/2002 Hawkins et al.
6,491,362 B1 12/2002 Jeanmaire
6,505,921 B2 1/2003 Chwalek
6,554,410 B2 4/2003 Jeanmaire et al.
6,575,566 B1 6/2003 Jeanmaire et al.
6,588,888 B2 7/2003 Jeanmaire et al.

FOREIGN PATENT DOCUMENTS

EP 1 219 429 7/2002

* cited by examiner

*Primary Examiner*—An H Do
(74) *Attorney, Agent, or Firm*—William R. Zimmerli

(57) ABSTRACT

A printing system includes a liquid drop ejector, a fluid flow device, and a fluid flow source. The liquid drop ejector is operable to eject liquid drops having a plurality of volumes along a first path. The fluid flow device includes a first section comprising a plurality of sub-channels created by a partition and a second section comprising a plurality of sub-channels created by a partition. Each partition has a height as viewed from a wall of the fluid flow device. The height of the partition of the second section is less than the height of the partition of the first section. The fluid flow source is operable to produce a fluid flow through the fluid flow device. The fluid flow interacts with the liquid drops to cause liquids drops having one of the plurality of volumes to begin moving along a second path.

17 Claims, 10 Drawing Sheets

REPLACEMENT SHEET
U.S. Patent Application Serial No. 11/744,987
Filing Date: May 7, 2007

CONTINUOUS PRINTING APPARATUS HAVING IMPROVED DEFLECTOR MECHANISM

FIELD OF THE INVENTION

This invention relates generally to the management of fluid flow and, in particular to the management of fluid flow in printing systems.

BACKGROUND OF THE INVENTION

Printing systems that deflect drops using a gas flow are known, see, for example, U.S. Pat. No. 4,068,241, issued to Yamada, on Jan. 10, 1978.

The device that provides gas flow to the gas flow drop interaction area can introduce turbulence in the gas flow that may augment and ultimately interfere with accurate drop deflection or divergence. Turbulent flow introduced from the gas supply typically increases or grows as the gas flow moves through the structure or plenum used to carry the gas flow to the gas flow drop interaction area of the printing system.

Drop deflection or divergence can be affected when turbulence, the randomly fluctuating motion of a fluid, is present in, for example, the interaction area of the drops that are traveling along a path and the gas flow force. The effect of turbulence on the drops can vary depending on the size of the drops. For example, when relatively small volume drops are caused to deflect or diverge from the path by the gas flow force, turbulence can randomly disorient small volume drops resulting in reduced drop deflection or divergence accuracy which, in turn, can lead to reduced drop placement accuracy.

Accordingly, a need exists to reduce turbulent gas flow in the gas flow drop interaction area of a printing system.

SUMMARY OF THE INVENTION

According to one aspect of the invention, a printing system includes a liquid drop ejector, a fluid flow device, and a fluid flow source. The liquid drop ejector is operable to eject liquid drops having a plurality of volumes along a first path. The fluid flow device includes a first section having a first volume and a second section having a second volume with the first volume being greater than the second volume. The fluid flow source is operable to produce a fluid flow through the fluid flow device. The fluid flow interacts with the liquid drops to cause liquids drops having one of the plurality of volumes to begin moving along a second path.

According to another aspect of the invention, a printing system includes a liquid drop ejector, a fluid flow device, and a fluid flow source. The liquid drop ejector is operable to eject liquid drops having a plurality of volumes along a first path. The fluid flow device includes a first section comprising a plurality of sub-channels created by a partition and a second section comprising a plurality of sub-channels created by a partition. Each partition has a height as viewed from a wall of the fluid flow device. The height of the partition of the second section is less than the height of the partition of the first section. The fluid flow source is operable to produce a fluid flow through the fluid flow device. The fluid flow interacts with the liquid drops to cause liquids drops having one of the plurality of volumes to begin moving along a second path.

According to another aspect of the invention, a method of printing includes causing a liquid drop ejector to eject liquid drops having a plurality of volumes along a first path; providing a fluid flow device including a first section having a first volume and a second section having a second volume, the first volume being greater than the second volume; providing a fluid flow source operable to produce a fluid flow through the fluid flow device; and causing the fluid flow to flow through the fluid flow device such that the fluid flow interacts with the liquid drops to cause liquids drops having one of the plurality of volumes to begin moving along a second path.

According to another aspect of the invention, a method of printing includes providing a liquid drop ejector operable to eject liquid drops having a plurality of volumes along a first path; providing a fluid flow device including a first section comprising a plurality of sub-channels created by a partition and a second section comprising a plurality of sub-channels created by a partition, each partition having a height as viewed from a wall of the fluid flow device, the height of the partition of the second section being less than the height of the partition of the first section; providing a fluid flow source operable to produce a fluid flow through the fluid flow device; and causing the fluid flow to flow through the fluid flow device such that the fluid flow interacts with the liquid drops to cause liquids drops having one of the plurality of volumes to begin moving along a second path.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
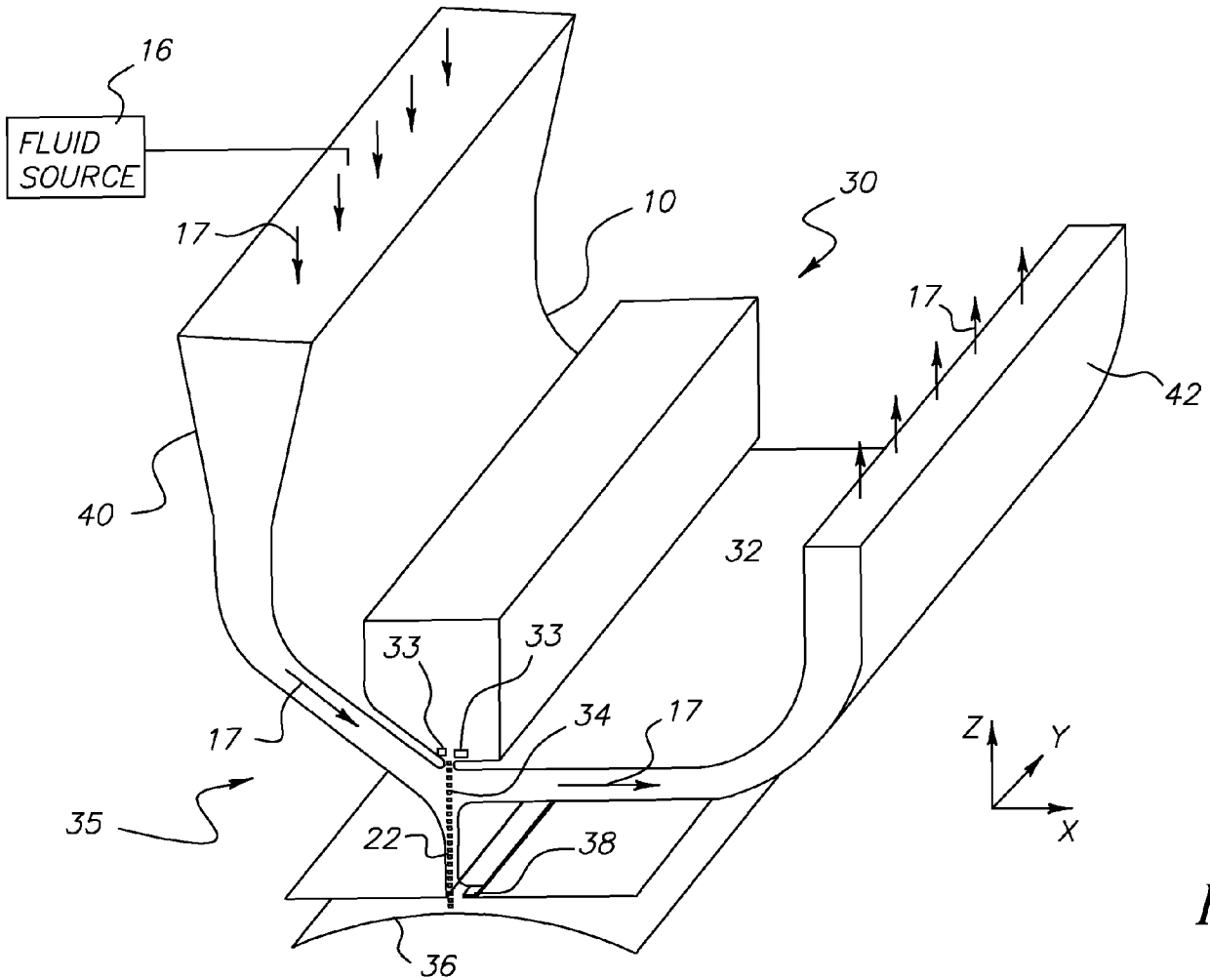
FIG. 1 is a three-dimensional schematic view of a printing system including an embodiment of the present invention.

The present description will be directed in particular to elements forming part of, or cooperating more directly with, apparatus in accordance with the present invention. It is to be understood that elements not specifically shown or described may take various forms well known to those skilled in the art.

The example embodiments of the present invention are illustrated schematically and not to scale for the sake of clarity. One of ordinary skill in the art will be able to readily determine the specific size and interconnections of the elements of the example embodiments of the present invention. In the following description, identical reference numerals have been used, where possible, to designate identical elements.

Although the term printing system is used herein, it is recognized that printing systems are being used today to eject other types of liquids and not just ink. For example, the ejection of various fluids such as medicines, inks, pigments, dyes, and other materials is possible today using printing systems. As such, the term printing system is not intended to be limited to just systems that eject ink.

Referring to FIG. 1, a schematic view of a printing system 30 incorporating an example embodiment of a fluid flow device 10 is shown. Printing system 30 includes a liquid drop ejector or printhead 32 positioned to eject drops 34 through additional passage 22 of fluid flow device 10. At least some the drops 34 contact a receiver 36 while other drops are collected by a catcher 38.

Printhead 32 includes a drop forming mechanism 33 operable to form drops 34 having a plurality of volumes traveling along a first path. A drop deflector system 35 including fluid flow device 10 applies a gas flow force to the drops traveling along the first path. The gas flow force is applied in a direction such that drops having one of the plurality of volumes diverge (or deflect) from the first path and begin traveling along a second path while drops having another of the plurality of volumes remain traveling substantially along the first path or diverge (deflect) slightly and begin traveling along a third path. Receiver 36 is positioned along one of the first, second, and third paths while catcher 38 is positioned along another of the first, second and third paths depending on the specific application contemplated. Printheads like printhead 32 are known and have been described in, for example, U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al., on Jan. 14, 2003; U.S. Pat. No. 6,554,410 B2, issued to Jeanmaire et al., on Apr. 29, 2003; U.S. Pat. No. 6,575,566 B1, issued to Jeanmaire et al., on Jun. 10, 2003; and U.S. Pat. No. 6,588,888 B2, issued to Jeanmaire et al., on Jul. 8, 2003.

After being ejected by the drop forming mechanism 33 of printhead 32, drops 34 travel along the first path which is substantially perpendicular to printhead 32. Fluid flow device 10 is a suitably shaped metal or plastic structure that includes an inlet portion 40 and an outlet portion 42 located on either side of the travel path. A fluid flow source 16 is operatively associated with one or both of the inlet portion 40 and the outlet portion 42. For example, pressurized gas (e.g. air) from a pump can be introduced in the inlet portion 40 and/or a vacuum (negative air pressure relative to ambient operating conditions) from a vacuum pump can be introduced in the outlet portion 42. When fluid flow sources like these are introduced on the inlet portion 40 and the outlet portion 42 a sink for the fluid or gas flow is provided. The fluid or gas flow (represented by arrows 17) of the drop deflector interacts with ejected drops 34 and causes drops 34 to diverge or deflect as described above. The amount of deflection is volume dependent with smaller volume drops being deflected by the fluid or gas flow more than larger volume drops.

A Cartesian coordinate system x-y-z is also shown in FIG. 1. The three principal planes, of the Cartesian coordinate system, x-y, x-z, and y-z planes will be used to represent the cross-sectional planes of printing system 30. For example, the x-z plane cross-sectional view of printing system 30 is shown in FIG. 2. In all remaining figures, one of the principal planes will be shown to help relate the relative position of a two-dimensional view with respect to printing device 30 shown in FIG. 1.

Figure 2A:
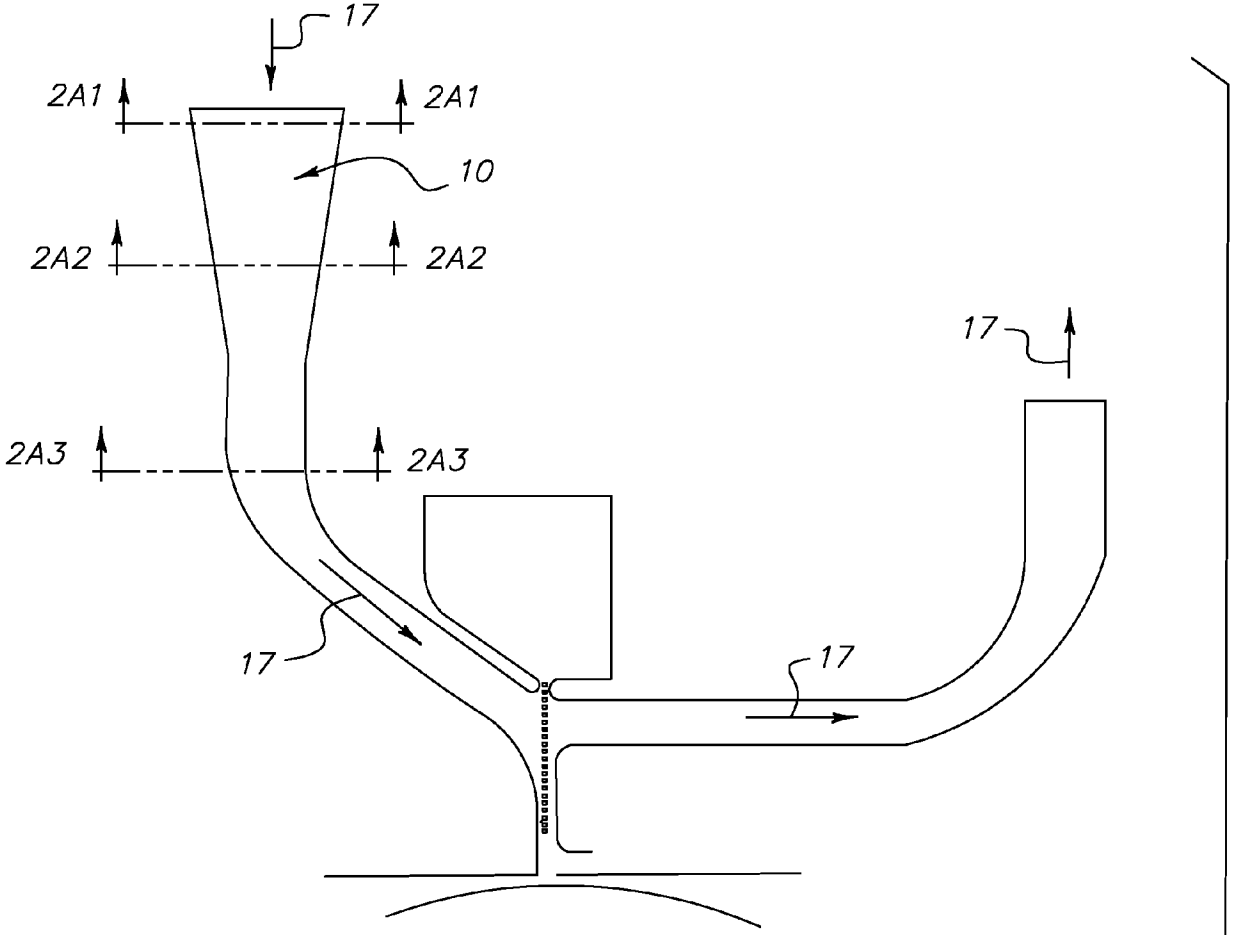
FIG. 2A is a two-dimensional schematic view of the printing system shown in FIG. 1.
Figure 2B:
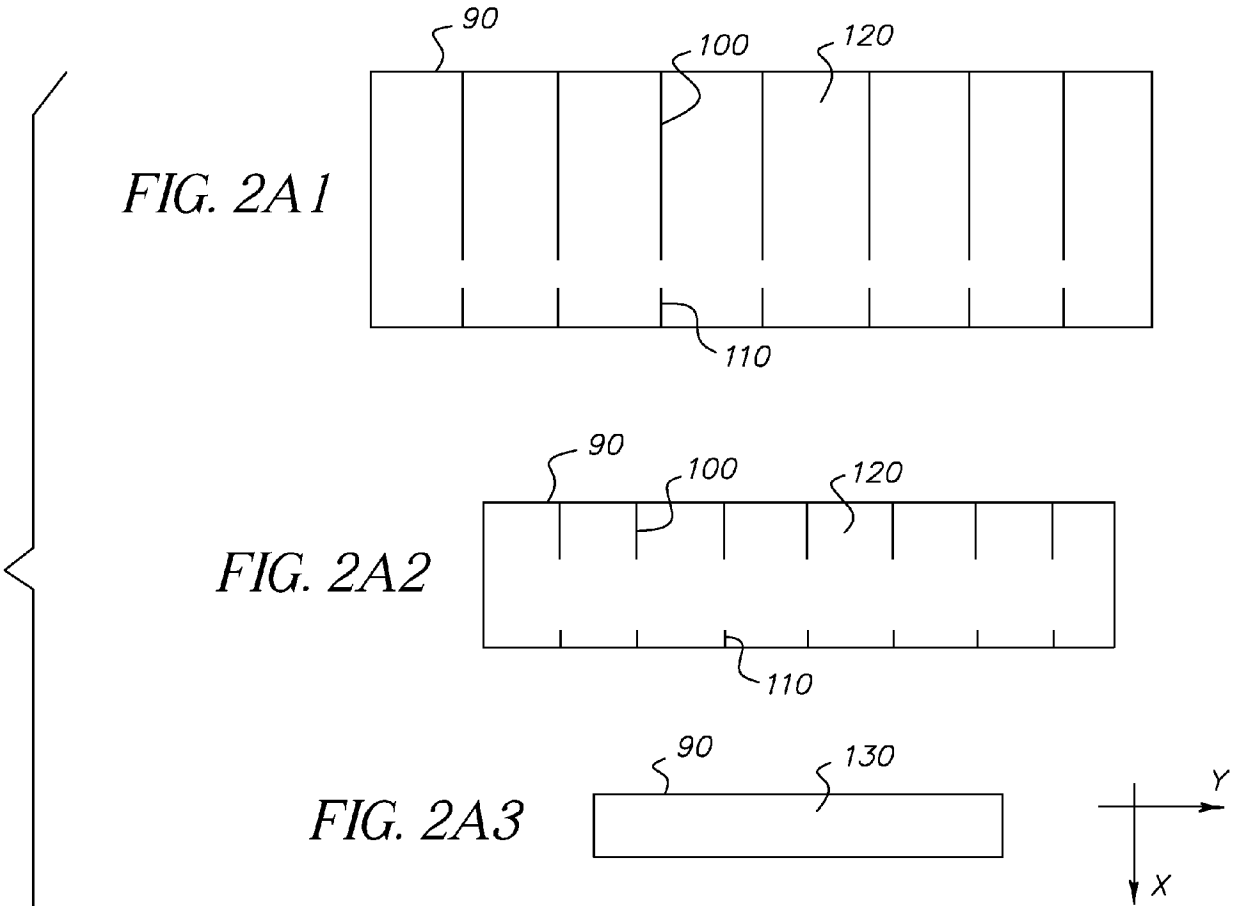
FIG. 2B includes cross-sectional views of a portion of the fluid flow device shown in FIG. 2A including an example embodiment of the present invention.

Referring to FIG. 2A, a schematic two-dimensional view, the x-z plane, of the printing system 30 shown in FIG. 1. FIG. 2B is a cross-sectional view, the x-y plane, of fluid device 10 at sections AA, BB and CC, a first section, a second section, and a third section, respectively, in this example embodiment. Near inlet 40, fluid flow device 10 includes sections that change along the flow path. For example, sections AA, BB and CC are different in two ways. First, the cross-sectional areas are different. The areas become smaller along the flow path from sections AA to BB to CC. Secondly, fluid device 10 contains sub-channels 120 that change along the flow path as shown in FIG. 2B. The inlet portion 40 at sections AA, BB and CC contains the outer wall 90 and partitions 100 and 110 that form flow sub-channels 120 of the fluid device 10. The heights of the partitions 100 and 110 decreases along the flow path from sections AA to BB to CC. At section CC, the partitions 100 and 110 disappear. Sub-channels 120 merge into a single channel 130. From section CC and on, the flow travels along a single channel 130 through the printhead. In FIG. 2A, arrows 17 represent the direction of gas flow.

The volumes associated with sections AA, BB, and CC of fluid flow device 10 do not need to be equal, but can be. For example, the volume associated with section AA of fluid flow device 10 can be greater than the volume associated with section BB which, in turn, can be greater than the volume associated with section CC as viewed along a path of fluid flow device 10 beginning at a location removed (or farther away) from the area of gas flow drop interaction and ending at a location that is adjacent (or closer) to the area of gas flow drop interaction. Alternatively stated, the volume associated with section CC of fluid flow device 10 can be less than the volume associated with section BB which, in turn, can be less than the volume associated with section AA.

A typical way to provide gas supply to the inlet is to use a fan to blow gas into a supply plenum. However, this normally introduces turbulence in the gas supply that will augment and interfere with the accurate ink drop deflection. The invention helps to reduce turbulence by introducing sub-channels 120 along the gas moving direction in the supply plenum. The introduction of sub-channels 120 reduces the characteristic distance of the flow. From fluid mechanics, the factor that determines whether a flow is laminar or turbulent is the ratio of inertia forces to viscous forces within the fluid, by the nondimentional Reynolds Number, $$\mathrm{Re} = \frac{\rho V D}{\mu}$$

where ρ is the density, μ is the viscosity of the fluid; V is flow characteristic velocity and D is the characteristic length of the channel. For example, for flow in a pipe, V could be the average flow velocity, and D would be the pipe diameter. Fluid flows are laminar for Reynolds Number up to 2000. Beyond a Reynolds Number of 4000, the flow is completely turbulent. From 2000 to 4000, the flow is in transition between laminar and turbulent. The introduction of sub-channels 120 reduces the characteristic length D and, thus reduces the Reynolds Number, indicating turbulence being suppressed.

Figure 3:
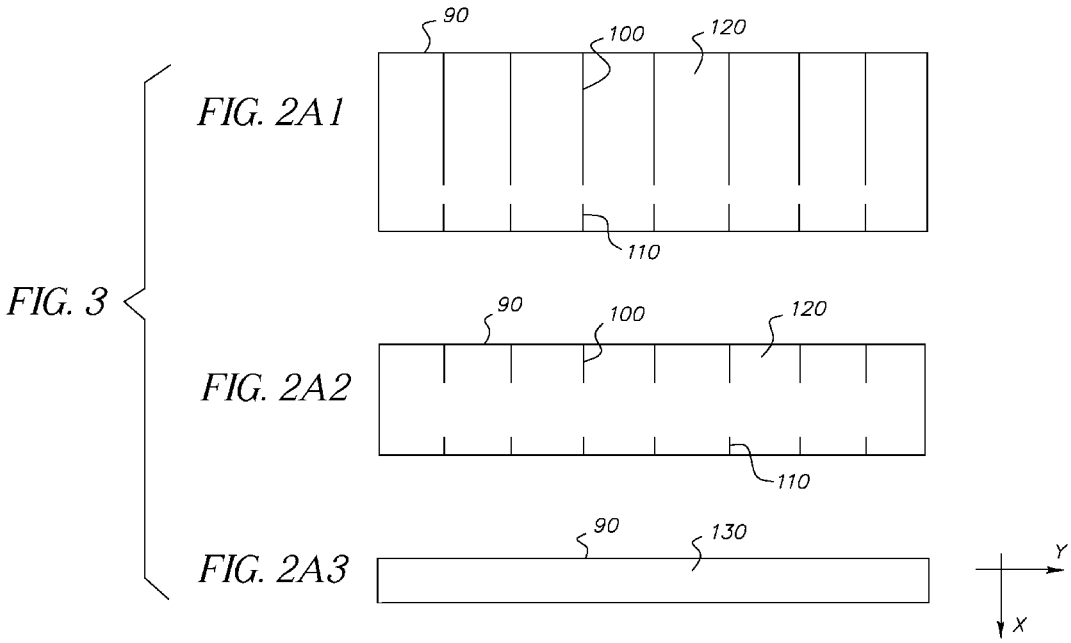
FIG. 3 includes cross-sectional views of another example embodiment of the present invention.

Referring to FIG. 3, a schematic two-dimensional view of partitions 100 and 110 along the flow path from sections AA to BB to CC is shown. Unlike the embodiment shown in FIG. 2B, where the dimensions in x and y direction of cross-section reduces from sections AA to BB to CC, the width of fluid device 10 in y direction in FIG. 3 remains unchanged from sections AA to BB to CC. The width of fluid device 10 in x direction, however, decreases from sections AA to BB to CC.

Figure 4:
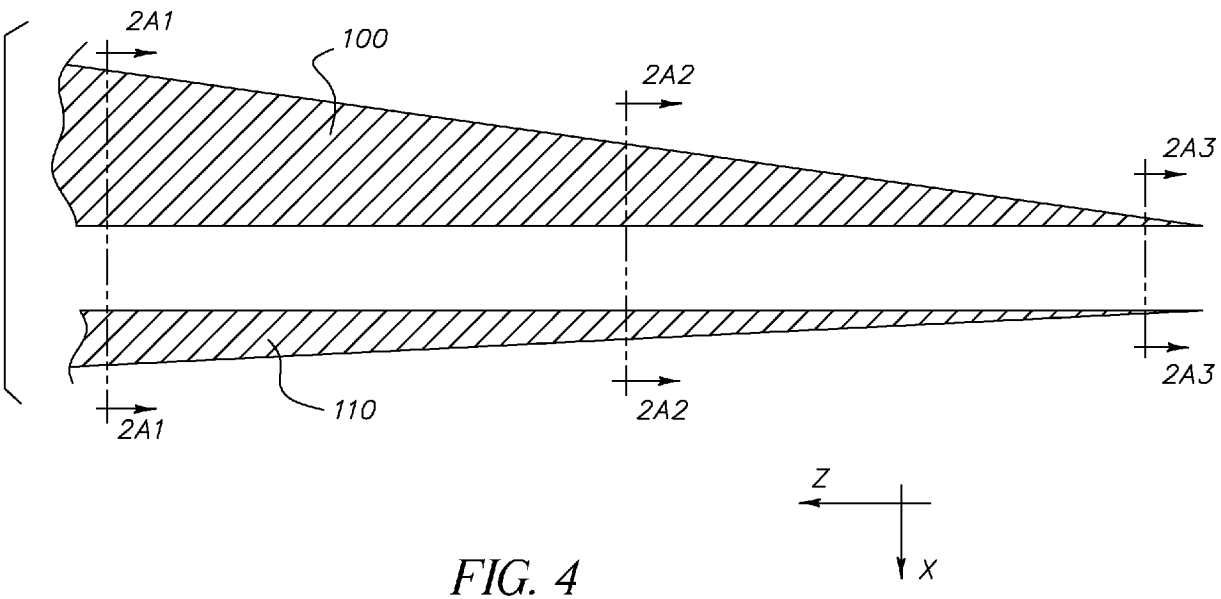
FIG. 4 is a cross-sectional view of another example embodiment of the present invention illustrating a gradual change in heights of partitions.

Referring to FIG. 4, a schematic two-dimensional view of partitions 100 and 110 along the flow path from sections AA to BB to CC is shown. This is a cross-sectional view of fluid device 10 in the x-z plane. The profiles of partitions are shown as shaded areas. In this example embodiment, the decrease in heights, from sections AA to BB to CC, of partitions 100 and 110 is gradual and continuous as shown in FIG. 4. Partitions 100 and 110 cease to exist at section CC. Of course, the gradual and continuous decrease in heights of partitions 100 and 110 is not limited to be linear as shown in FIG. 4. Any other form continuous profiles are acceptable as well.

Figure 5:
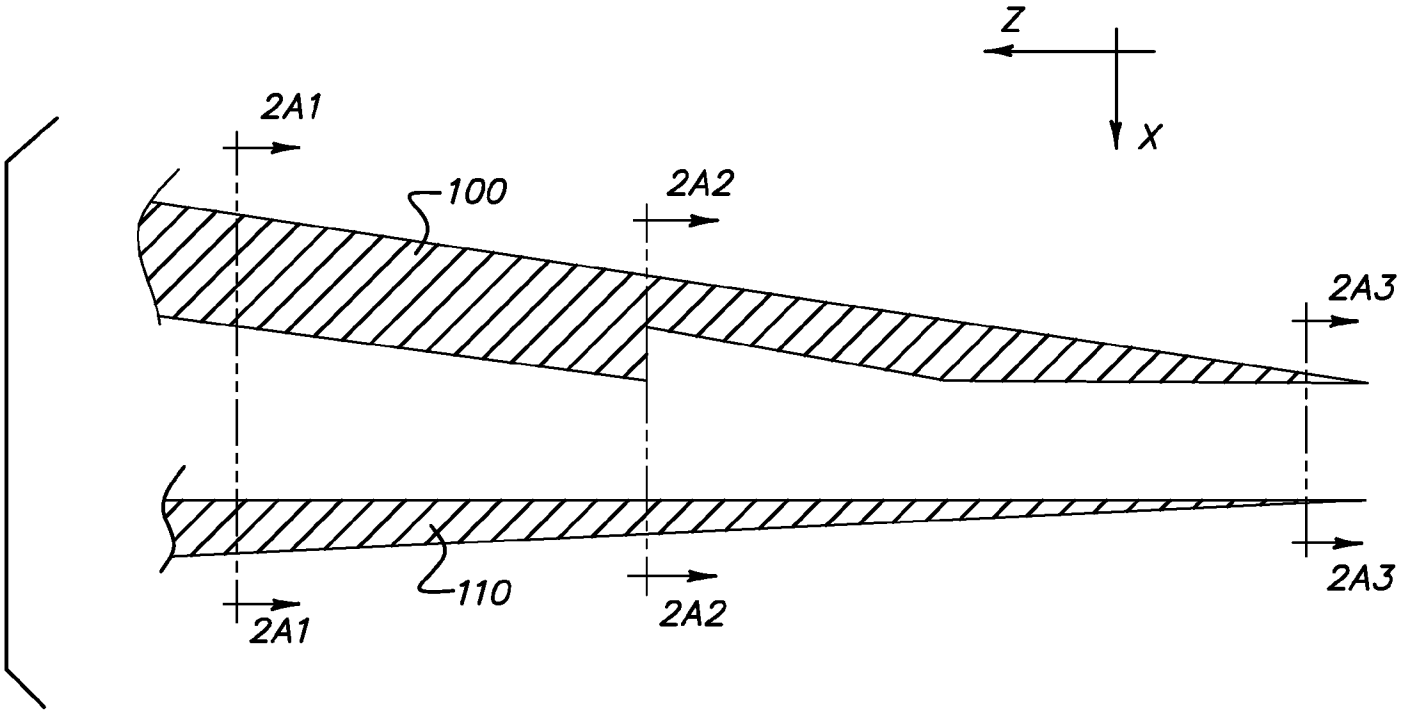
FIG. 5 is a cross-sectional view of another example embodiment of the present invention illustrating a non-gradual change in heights of partitions.

Referring to FIG. 5, a schematic two-dimensional view of partitions 100 and 110 along the flow path from sections AA to BB to CC is shown. This is a cross-sectional view of fluid device 10 in the x-z plane. The profiles of partitions are shown as shaded areas. In this example embodiment, the decrease in heights, from sections AA to BB to CC, of internal wall 100 is not gradual or continuous. It has a abrupt change in height near section BB. Partitions 100 and 110 cease to exist at section CC so that the flow is uniform from section CC to the area where the flow interacts with drops 34. The decrease in heights of partitions 100 and 110 can be a combination of gradual/continuous change discussed in FIG. 4 and non-gradual/discontinuous change shown in FIG. 5.

Figure 6:
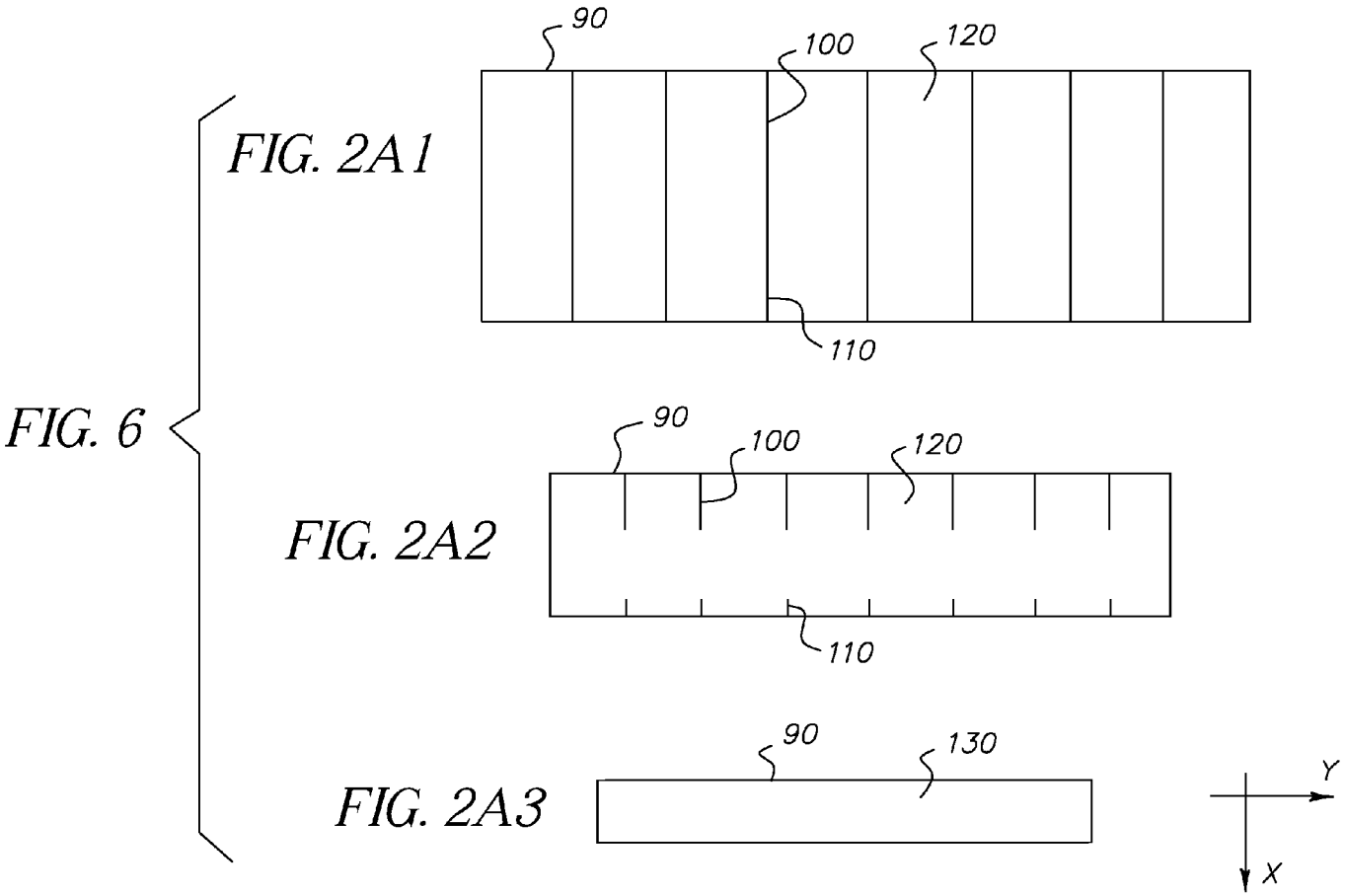
FIG. 6 includes cross-sectional views of another example embodiment of the present invention.

Referring to FIG. 6, a schematic cross-sectional view of fluid device 10 at section AA, BB and CC is shown. In this example embodiment, the walls 110 and 100 at section AA are connected to form closed sub-channels 120. The heights of the partitions 100 and 110 decrease along the flow path from sections AA to BB to CC. At section CC, the partitions 100 and 110 disappear. Sub-channels 120 merge into a single channel 130. From section CC and on, the flow travels along a single channel 130, passing through the printhead.

Figure 7:
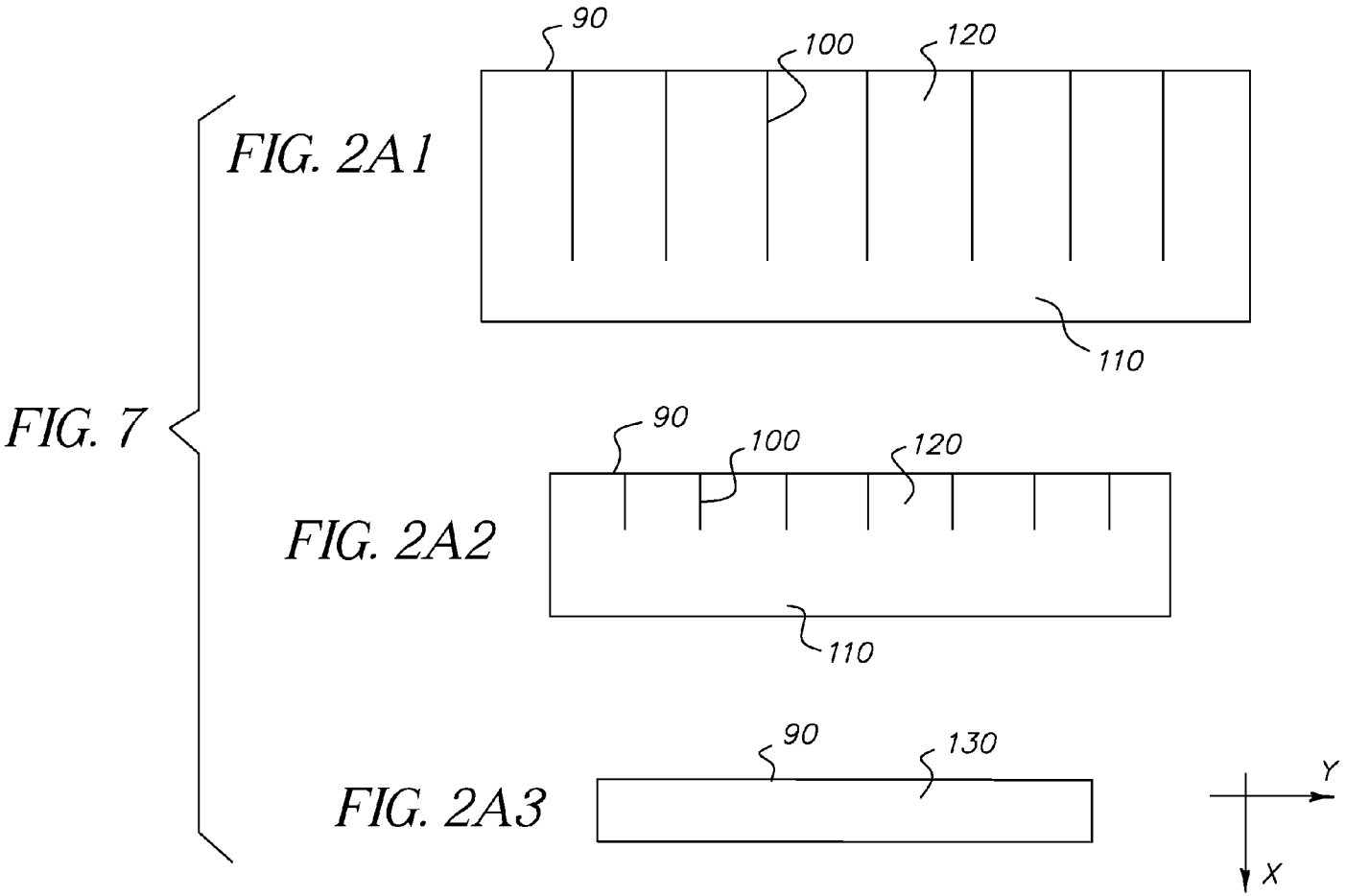
FIG. 7 includes cross-sectional views of another example embodiment of the present invention.
Figure 8:
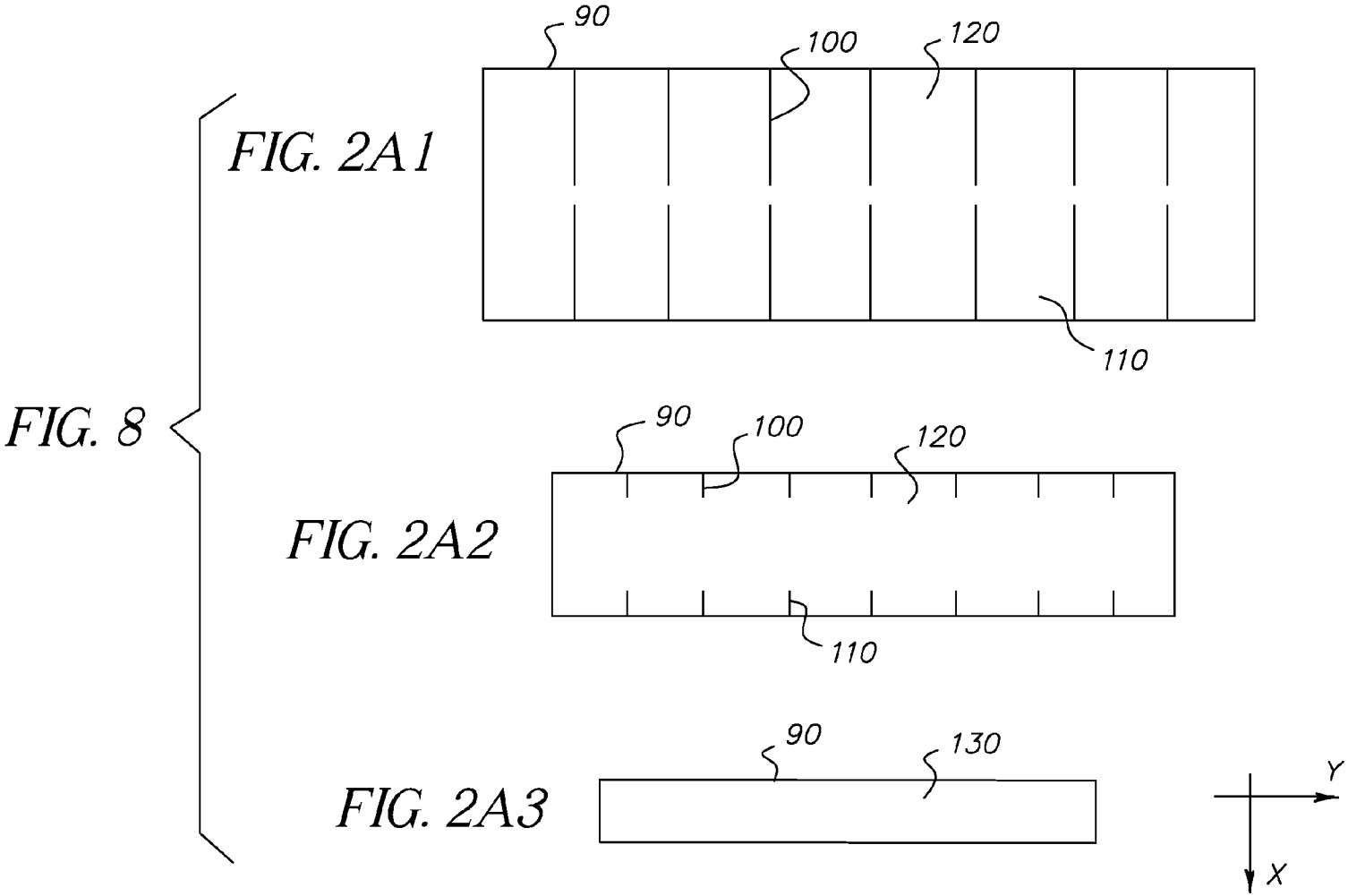
FIG. 8 includes cross-sectional views of another example embodiment of the present invention.

Referring to FIG. 7, a schematic cross-sectional view of fluid device 10 at section AA, BB and CC is shown. In this example embodiment, sub-channels are formed by outer wall 90 and internal wall 100 without internal wall 110. The height of the internal wall 100 decreases along the flow path from sections AA to BB to CC. At section CC, the internal wall 100 disappears. Sub-channels 120 merge into a single channel 130. From section CC and on, the flow travels along a single channel 130 through the printhead. In another embodiment, partitions 100 and 110 have the same heights and distributed symmetrically as shown in FIG. 8. In addition, partitions 110 and 100 may or may not be evenly distributed along the outer wall 90 as referenced from a centerline of the particular section positioned parallel to either the x coordinate or y coordinate. The height of internal wall 100 or internal 110 may vary along outer wall 90 at a section.

Figure 9:
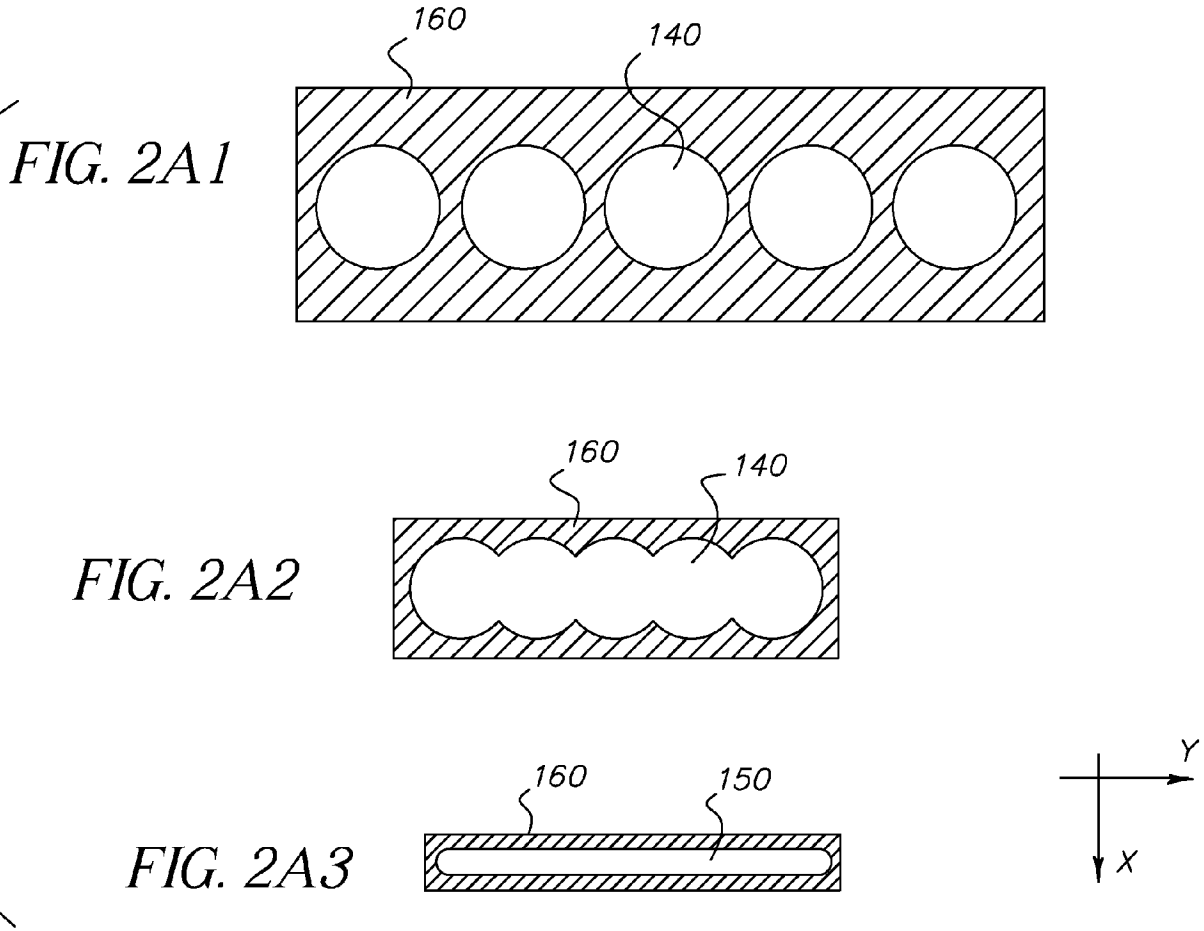
FIG. 9 includes cross-sectional views of another example embodiment of the present invention.

The structure of fluid flow device 10 near inlet 40 is not limited by sub-channels formed by external wall 90 and partitions 100 or 110. In a example embodiment shown in FIG. 9, the sub-channels are formed from holes 140 that eventually merge together as a single channel 150. Holes 140 can be obtained by drilling through flank 160. Of course, the shape of the holes are not limited to that of circular cross-section (AA) or substantially circular cross-section (section BB).

Additionally, flow velocities of the fluid flow and the ejected drops can be adjusted in order to help reduce turbulence in the area of drop and fluid flow interaction. For example, either or both of these velocities can be adjusted such that the velocities are, preferably, substantially equivalent. This can be accomplished, for example, by measuring drop velocity using any known method and then adjusting the fluid flow source to provide the desired fluid flow velocity. When this is done, turbulence in the area of drop and fluid flow interaction can be reduced.

The invention has been described in detail with particular reference to certain example embodiments thereof, but it will be understood that variations and modifications can be effected within the scope of the invention.

PARTS LIST

10 fluid flow device
16 fluid flow source
17 arrows
22 additional passage
30 printing system
32 printhead
33 drop forming mechanism
34 drops
35 deflector system
36 receiver
38 catcher
40 inlet portion
42 outlet portion
90 outer wall
100 partitions
110 partitions
120 sub-channels
130 single channel
140 holes
150 single channel
160 flank

The invention claimed is:

1. A printing system comprising:

a liquid drop ejector operable to eject liquid drops having a plurality of volumes along a first path;

a fluid flow device including a first section having a first area and a second section having a second area, the first area being greater than the second area; and a gas flow source operable to produce a gas flow through the fluid flow device such that the gas flow interacts with the liquid drops in a region to cause liquids drops having one of the plurality of volumes to diverge from the first path and begin moving along a second path, the first section of the fluid device through which the gas flows being located farther away from the gas flow liquid drop interaction region than the second section of the fluid flow device through which the gas flows as viewed along the gas flow path.

2. The system according to claim 1, the first section of the fluid flow device comprising a plurality of sub-channels created by a partition and the second section of the fluid flow device comprising a plurality of sub-channels created by a partition, each partition having a height as viewed from a wall of the fluid flow device, wherein the height of the partition of the second section is less than the height of the partition of the first section.

3. The system according to claim 2, the fluid flow device including a third section having a third area, the area of the third section being less than the area of the second section, the third section having no sub-channels.

4. The system according to claim 1, the first section of the fluid flow device comprising a plurality of enclosed sub-channels and the second section of the fluid flow device comprising a plurality of enclosed sub-channels, the plurality of enclosed sub-channels of the first section having a volume, the plurality of enclosed sub-channels of the second section having a volume, wherein the volume of the plurality of enclosed sub-channels of the first section is greater than the volume of the plurality of enclosed sub-channels of the second section.

5. The system according to claim 4, wherein at least one of the plurality of enclosed sub-channels of the first section and the second section have a circular cross sectional area.

6. The system according to claim 1, the first section of the fluid flow device including an opening having a cross sectional area, the second section of the fluid flow device including an opening having a cross sectional area, the cross sectional area of the opening of the first section being greater than the cross sectional area of the opening of the second section.

7. The system according to claim 1, the first section of the fluid flow device including a first volume and the second section of the fluid flow device including a second volume, wherein the first volume is not equal to the second volume.

8. A printing system comprising:

a liquid drop ejector operable to eject liquid drops having a plurality of volumes along a first path;

a fluid flow device including a first section comprising a plurality of sub-channels created by a partition and a second section comprising a plurality of sub-channels created by a partition, each partition having a height as viewed from a wall of the fluid flow device, the height of the partition of the second section being less than the height of the partition of the first section; and a gas flow source operable to produce a gas flow through the fluid flow device such that the gas flow interacts with the liquid drops in a region to cause liquid drops having one of the plurality of volumes to diverge from the first path and begin moving along a second path, the first section of the fluid flow device through which the gas flows being located farther away from the gas flow liquid drop interaction region than the second section of the fluid flow device through which the gas flows as viewed along the gas flow path.

9. The system according to claim 8, the first section of the fluid flow device including a first volume and the second section of the fluid flow device including a second volume, wherein the first volume is not equal to the second volume.

10. The system according to claim 8, the partition of one of the first section and the second section including a plurality of partitions, wherein the height of one of the plurality of partitions is less than the height of another of the plurality of partitions.

11. The system according to claim 8, the partition of one of the first section and the second section including a plurality of partitions, wherein the height of one of the plurality of partitions is equivalent to the height of another of the plurality of partitions.

12. The system according to claim 8, the partition of one of the first section and the second section including a plurality of partitions, wherein each of the plurality of partitions is equally spaced relative to each other.

13. The system according to claim 8, the fluid flow device including a centerline, the partition of one of the first section and the second section including a plurality of partitions, wherein one of the plurality of partitions is symmetric to another of the plurality of partitions about the centerline of the fluid flow device.

14. The system according to claim 8, wherein the partition of one of the first section and the second section extends from only one wall of the fluid flow device.

15. The system according to claim 8, the first section of the fluid flow device including a first area and the second section of the fluid flow device including a second area, the first area being greater than the second area.

16. A method of printing comprising:

causing a liquid drop ejector to eject liquid drops having a plurality of volumes along a first path;

providing a fluid flow device including a first section having a first area and a second section having a second area, the first being greater than the second area;

providing a gas flow source operable to produce a gas flow through the fluid flow device; and causing the gas flow to flow through the fluid flow device such that the gas flow interacts with the liquid drops in a region to cause liquids drops having one of the plurality of volumes to diverge from the first path and begin moving along a second path, the first section of the fluid device through which the gas flows being located farther away from the gas flow liquid drop interaction region than the second section of the fluid flow device through which the gas flows as viewed along the gas flow path.

17. A method of printing comprising:

providing a liquid drop ejector operable to eject liquid drops having a plurality of volumes along a first path;

providing a fluid flow device including a first section comprising a plurality of sub-channels created by a partition and a second section comprising a plurality of sub-channels created by a partition, each partition having a height as viewed from a wall of the fluid flow device, the height of the partition of the second section being less than the height of the partition of the first section;

providing a gas flow source operable to produce a gas flow through the fluid flow device; and causing the gas flow to flow through the fluid flow device such that the gas flow interacts with the liquid drops in a region to cause liquids drops having one of the plurality of volumes to diverge from the first path and begin moving along a second path, the first section of the fluid device through which the gas flows being located farther away from the gas flow liquid drop interaction region than the second section of the fluid flow device through which the gas flows as viewed along the gas flow path.

* * * * *